US005430459A

United States Patent [19]

Clerc

[11] Patent Number: 5,430,459

[45] Date of Patent: Jul. 4, 1995

[54] CATHODOLUMINESCENT DISPLAY MEANS USING GUIDED ELECTRONS AND ITS CONTROL PROCESS

[76] Inventor: Jean F. Clerc, Saint martin du Mont, Sagy, France, 71580

[21] Appl. No.: 916,097

[22] PCT Filed: Nov. 29, 1990

[86] PCT No.: PCT/FR90/00864

§ 371 Date: Jul. 25, 1992

§ 102(e) Date: Jul. 25, 1992

[87] PCT Pub. No.: WO92/09981

PCT Pub. Date: Jun. 11, 1992

[51] Int. Cl.[6] ..... G09G 3/30

[52] U.S. Cl. ..... 345/74; 313/497; 313/495; 345/75

[58] Field of Search ..... 340/781, 772; 313/308, 313/309, 495–497; 345/74, 75, 107, 36, 37, 45, 76, 47; 348/797, 800

[56] References Cited

U.S. PATENT DOCUMENTS 4,030,090 6/1977 Endriz ..... 345/74
4,429,303 1/1984 Aboelfotoh ..... 340/772
4,486,749 12/1984 Kishino et al. ..... 340/772
4,575,765 3/1986 Hirt ..... 345/74
4,683,399 7/1987 Soclof ..... 313/309
5,015,912 5/1991 Spindt et al. ..... 345/74

FOREIGN PATENT DOCUMENTS 2067829 7/1981 United Kingdom .
2070851 9/1981 United Kingdom .

*Primary Examiner*—Ulysses Weldon
*Assistant Examiner*—Amare Mengistu

[57] ABSTRACT

The present invention provides a cathodoluminescent display which uses guided electrons and a control process for such display. The display is in matrix form, an image or picture point or dot being formed at each row-column intersection. Opposite the columns, outside the image dots, a source continuously emits electrons. As a function of the signal which it receives, a column electrode guides up to the selected row the electrons emitted opposite it, or drives them back to the source. The guidance column electrodes are covered by an electrically insulating layer, the guidance of the electrons taking place in a vacuum in the immediate vicinity of the insulant perpendicular to the guidance electrodes.

7 Claims, 7 Drawing Sheets

V
Vfs
Vc "ON"
Vf1
t
Vf2
V1ns
Vc "OFF"

"ON"
"OFF"
τ1
τ2
τ3
τ4
T

CATHODOLUMINESCENT DISPLAY MEANS USING GUIDED ELECTRONS AND ITS CONTROL PROCESS

BACKGROUND OF THE INVENTION

The present invention relates to a cathodoluminescent display means using guided electrons and its control process. The invention more particularly applies to the production of displays permitting the display of fixed or moving pictures.

Known cathodoluminescent screens or displays are the cathode ray tube, the vacuum fluorescent display (V.F.D.) and the microdot fluorescent screen or display. The main known characteristics of these types of cathodoluminescent screen or displays will now be described.

The cathode ray tube has a vacuum cell with a thick glass plate (several centimetres) of limited curvature, a thinner glass envelope (approximately 1 cm) and which is approximately conical and tightly sealed to the thick glass plate and an electron gun located in the narrow terminal part of the conical envelope. Coils outside the conical envelope ensure the electromagnetic deflection of the electron beam from the gun. The electrons strike a cathodoluminescent layer deposited on the inner face of the thick glass plate, which is located in the vacuum enclosure and raised to a potential of several dozen kilovolts. The cathodoluminescent material is, for example, zinc sulphide.

The minimum depth of the cathode ray tube is on the one hand given by the aperture angle of the conical envelope directly linked with the maximum electromagnetic deflection angle of the electron beam and on the other hand by the minimum length of the actual electron bean. The ratio of the diagonal of the display to the depth remains, in the case of the conventional cathode tube, less than two. Therefore, the cathode tube does not constitute a fiat screen, even when the glass plate with the face forwards is approximately planar.

Moreover, with the useful size of the screen there is also an increase in the respective thicknesses of the plate and the envelope, both made of glass and therefore, a corresponding increase in the weight of the screen or delay. A cathode ray tube whereof the screen diagonal is 1 meter, at present weighs about 130 kg.

The vacuum fluorescence display has a vacuum cell incorporating two planar glass plates sealed by a tight cord or bead. The first slab optionally carries on its inner face located in the vacuum enclosure, a single electrode constituting an earth plane. Between the two plates within the vacuum enclosure there are in two successive planes two metal conductor levels.

At the first level, close to the first plate, are located taut metal wires heated by the Joule effect. They constitute cathodic filaments emitting electrons by the thermoionic effect. At the second level, close the second plate, are provided perforated, taut, metal strips. They constitute gate electrodes extracting and accelerating the electrons when they are selected, i.e. raised to a sufficiently high potential.

The second plate carries on its inner face located within the vacuum enclosure an array of transparent electrodes covered with an electroluminescent and slightly conductive material. They constitute anodes collecting the electrons extracted in their vicinity by a selected gate when their potential is sufficiently high and in particular higher than the respective potentials of the gates.

By striking the cathodoluminescent material the electrons bring about a light emission. The cathodoluminescent material is, for example, zinc sulphide. The filaments are, for example, of tungsten, the gates of aluminium and the anodes of indium oxide. The vacuum luminescent screen or display has a limited electron emission yield or efficiency outside the filaments. The filaments cannot be raised to high temperatures favourable for high efficiency levels, because they would be luminous and therefore visible.

The vacuum fluorescent display can only offer an image of limited size. The intermediate metallic levels Of taut gates and filaments require mechanical supports. They would be visible when located inside the useful zone of the display. Located at the periphery of the display they cannot prevent the filaments and gates from bending under the effect of their own weight and thermal expansion and the plates under the effect of the atmospheric pressure. The greater the size of the display, the greater the bending effects. The surface of the vacuum fluorescent displays is at present limited to a few square decimeters.

The microdot fluorescent display is known and described in the report of the international congress "Japan Display 86", p 512. The microdot fluorescent display incorporates a vacuum cell having a first glass plate on which are deposited cathode conductors supporting metal microdots. The cathode conductors are separated from a gate conductor deposited on the same plate by an electrically insulating layer. The gate conductor and the insulating layer are perforated in front of each microdot. The thus formed openings permit the passage of the microdots. A fluorescent material layer faces the gates and is deposited on the anode conductors, which rest on the second glass plate.

The two glass plates are tightly sealed so as to form a vacuum enclosure. Microspacers, positioned between the two glass plates, bear on the one hand on the metal of the gates of the first plate and on the other on the cathodoluminescent material of the second plate, making it possible to maintain a uniform distance between the two plates no matter what the surface of the cell and even when the glass of the plates is approximately 1 mm.

The cathodoluminescent material is, for example, zinc sulphate, the material of the cathodes and the anodes being of tin-doped indium oxide, while the material of the dots is molybdenum and that of the gates aluminium. The microspacers are, for example, calibrated glass balls with a diameter of approximately 200 microns.

The microdot fluorescent display has significant brightness inhomogeneities. The production of microdots with a height of approximately 1 micron and a base diameter of approximately 1 micron, uses microelectronic procedures. The present produced microdot fluorescent displays have a size less than 10 cm diagonal.

SUMMARY OF THE INVENTION

The present invention makes it possible to combine in a single means qualities which have hitherto never listed simultaneously in known display means.

The size limits of vacuum fluorescent or cathode ray tube-type screens or displays do not apply to the means according to the invention, which is compatible with the use of microspacers. The means according to the invention also has a good brightness uniformity, a high electron emission efficiency or yield when Using one or more filaments as the electron sources thereof because these, outside the active area of the display, can be heated up to luminescence.

More specifically, the present invention relates to a cathodoluminescent display means using, in a vacuum enclosure, the guidance of the electrons emitted by a known source using the thermoionic effect or the field effect, characterized in theft the electrons are guided, i.e. located and carried into finished volumes referred to as charge regions, which are located in the vacuum space of the enclosure and defined by guidance electrodes. Each guidance electrode is deposited on one of the walls of the vacuum enclosure, covered by an electrically insulating layer and raised to a potential above the electron emission potential. Each charge region is in contact with the electrical insulant, has a very fine thickness belong 1000 Angstroms and contours faithfully reproducing those of the guidance electrode positioned in perpendicular manner beneath the electrical insulant. The electrons move into the charge region of a guide perpendicular to the electric field applied, i.e. under the sole effect of the diffusion forces. The movement of the electrons is brought about by the extraction through the vacuum of the electrons from the charge region of the guide by means of an anode located at one end of the guide and raised to a potential higher than that of the guidance electrode, said extraction reducing the density of the electrons of the charge region, and by injection through the vacuum of electrons into the charge region of the guide by means of an electron source located at the other end of the guide and using potentials below that of the guidance electrode, said injection reestablishing the density of the electrons in the charge region of the guide.

According to a preferred embodiment, the display means comprises two glass plates assembled together by a tight sealing cord and forming a vacuum enclosure, the first plate carrying, on its inner face defining the vacuum enclosure, a first array of L independent electrodes known as row electrodes, the second plate carrying, on its inner face facing the first array of electrodes, a second array of N independent electrodes known as column electrodes, the two arrays intersecting in such a way that the intersection of the L rows and N columns defines the N times L elementary dots of the image, the surface occupied by said N times L dots being the active surface of the display, characterized in that the N column electrodes are covered, in the entire area within the sealing cord, by an electrically insulating layer, each of the row electrodes is covered in the active area by a slightly conductive cathodoluminescent material strip, each of the L strips being electrically in contact with the sole row electrode, the display means comprising an electron emitting source located within the vacuum enclosure, outside the active surface of the display, the electron source having electrical contact means outside the vacuum enclosure and the N columns and L lines have (N+L) electrical contact means outside the vacuum enclosure.

According to a preferred embodiment of the present invention, the electron source is constituted by a single filament facing the set of column electrodes, connected to the outside of the enclosure by two independent metal contacts, heated by the Joule effect and emitting electrons by the thermoionic effect.

According to another preferred embodiment of the present invention, the electron source is constituted by a large number of microfilaments positioned facing the set of column electrodes, each microfilament being connected on its ends to two conductive bars, which are themselves connected to the outside of the enclosure by two independent metal contacts, heated by the Joule effect and emitting electrons by the thermoionic effect.

According to another preferred embodiment of the present invention, the electron source is constituted by microdots positioned facing the array of column electrodes, the microdots being positioned on a cathodic conductor, which is itself deposited on the first plate and insulated by an electrical insulating layer from a second conductive level having an opening in front of each dot and fulfilling .the function of the extraction gate, the cathodic and gate conductors being connected to the outside of the enclosure by two independent contacts, the microdots emitting electrons by the field effect.

The invention also relates to a control process of the display means, where in each row i (i varying from 1 to L) receives a recurrent signal of period T having two sequences. The first, selection sequence of the row i having a duration $\tau i$, the second non-selection sequence of the row i having a duration (T-$\tau i$). During the selection time of the row i$\tau$Ti, the (L−1) other rows receive electric signals corresponding to the non-selection state. The signals applied to the electron emitting source are continuous signals of constant amplitude, during the time $\tau i$ for the selection of the row i. The signal applied to the row i $V_{row\ i}$ has an amplitude $V_{ls}$ lower than the of the continuous signals applied to the electron emitting source. During the time (T-$\tau i$) of non-selection of the row i, the signal applied to the row i $V_{row\ i}$ has an amplitude $V_{lns}$ lower than the amplitudes of the continuous signals applied to the electron emitting source. The light emission from a dot ij of the display at the intersection of the row i and the column j is obtained by applying to the column for the time $\tau i$ of the selection of the row i a signal $V_{column\ j}$ of amplitude $V_{C\text{'}ON\text{'}}$ respectively higher than the amplitudes of the continuous signals applied to the electron emitting source and lower than the amplitude $V_{ls}$ applied to the row i during the seine time $\tau i$. No light emission from a dot ij of the display is obtained by applying to the column j, during the selection time $\tau i$ of the row i, a signal $V_{column\ j}$ of amplitude $V_{C\text{'}OFF\text{'}}$ lower than the amplitudes of the continuous signals applied to the electron emitting source.

BRIEF DESCRIPTION OF THE DRAWINGS FIGURES

The invention is described in greater detail hereinafter relative to non-limitative embodiments and the attached drawings, wherein show:

FIG. 1 Exploded perspective view of a display cell according to the present invention in its form prior to assembly.

FIG. 2 Top plan view of the display cell shown in FIG. 1 following assembly thereof.

FIGS. 3A–3C Front perspective views of three electron emitting sources that can be used in the display cell of the present invention.

FIG. 4 Front elevational view of the display cell in accordance with the present invention.

FIG. 5 Front elevational view of a display cell illustrating the guidance of the electrons along a column from the electron emitting source to the selected row, said guidance being obtained when the column in question is in the "ON" state in accordance with the control process of the present invention.

FIG. 6 Front elevational view illustrating the confinement of the electrons around the electron emitting means, said confinement being obtained when the column in question is in the "OFF" state according to the control process of the present invention.

FIG. 7 A top and front perspective view of the display means of the present invention, with pieces broken away, to illustrate the operation of the display means.

FIG. 8A–8D Examples of a chronogram of the potentials respectively applied to a filament-type electron emitting source with one row and one column according to the control process of the invention.

DETAILED DESCRIPTION OF THE PREFERRED EMBODIMENT

Figure 1:
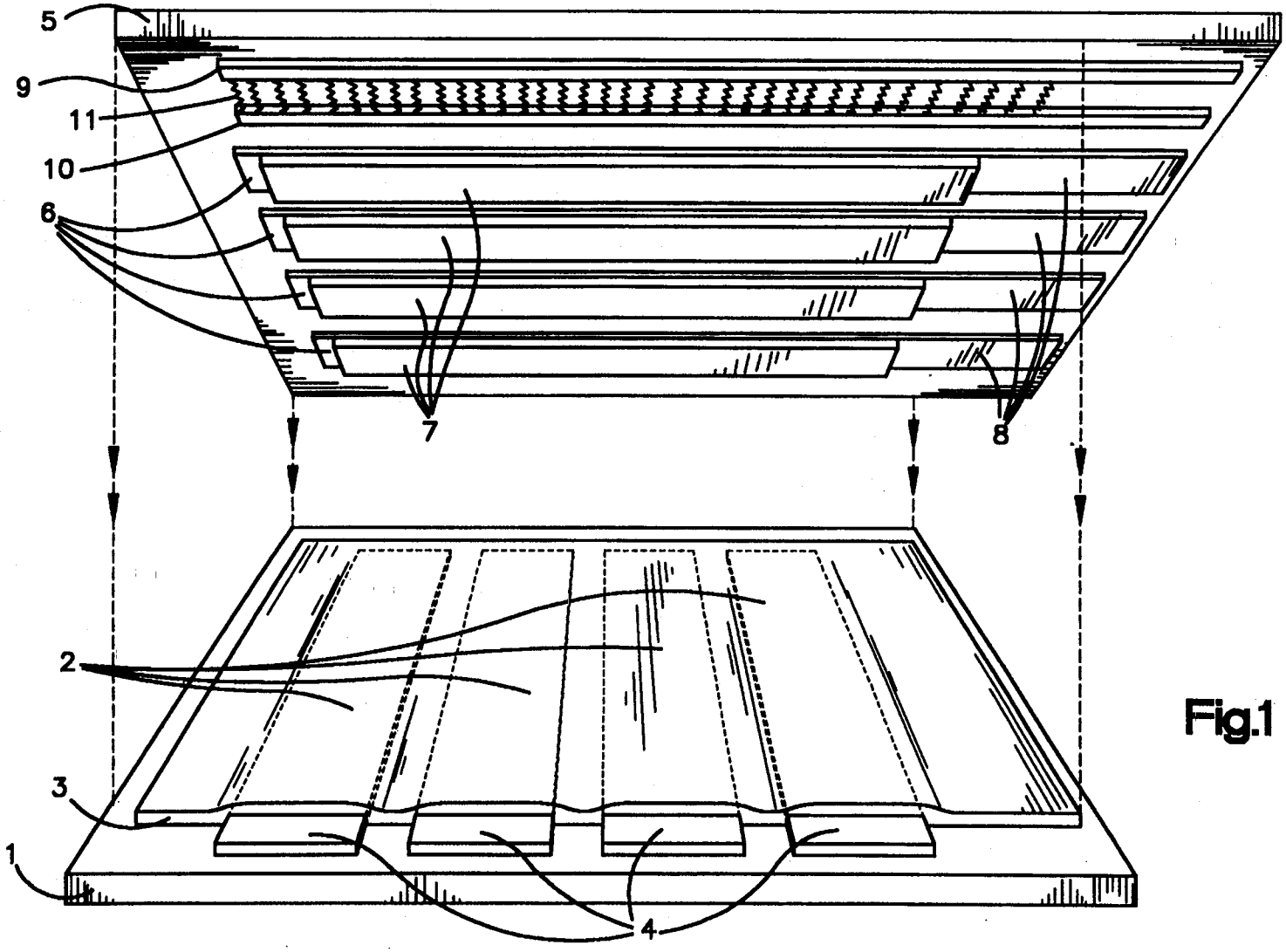

FIG. 1 is an exploded view of the display cell in its form prior to assembly. The display cell has two plates, namely a lower plate and an upper plate 5. The lower glass plate 1 has an array of electrodes 2 deposited on the glass substrate, the electrodes being rectangular and arranged vertically and are subsequently referred to as column electrodes, an insulating layer 3 covering the electrodes 2 over their entire surface with the exception of areas 4 making it possible to ensure the electrical contact between the electrodes and the not shown, external control means, said contact zones 4 being located at the periphery, e.g. as shown along one horizontal edge of the glass plate 1.

The thickness of the glass plate 1 is between 0.7 and 5 mm. The column electrodes are metallic, e.g. of aluminium. Their thickness is between a few hundred and a few thousand Angstroms. They are obtained by known means such as the deposition of a metal coating by vacuum evaporation followed by photolithography of the desired pattern.

The insulating layer 3 is e.g. of silica or silicon nitride and its thickness is between a few thousand Angstroms and a few microns. It is obtained by known means, e.g. vacuum sputtering of a uniform layer followed by photolithography of the desired pattern.

The upper glass plate 5 has an array of electrodes 6 deposited on the glass substrate, said electrodes being rectangular, positioned horizontally and are subsequently referred to as row electrodes, an array of horizontal cathodoluminescent strips 7, each strip having approximately the same width as a row electrode, but a smaller length, each strip covering the corresponding row electrode on the area positioned facing the array of column electrodes 2 of the opposite plate, while leaving access to an area 8 making it possible to ensure the electrical contact between the row electrode and a not shown external control means. The contact area 8 is located along the periphery, e.g. in the manner shown along the straight vertical edge of the glass plate 5 an electron emitting means, also called the electron source, e.g. using the thermoionic effect is formed by two horizontal conductive bars 9, 10 located outside the area occupied by the array of row electrodes 6, but facing the array of column electrodes 2 of the opposite slab. There is also a plurality of filaments 11 connected by their ends to the conductive bars 9 and 10.

The thickness of the glass plate 1 is between 0.7 and 5 mm. The row electrodes 6 are transparent, e.g. of tin-doped indium oxide and have a thickness between a few hundred and a few thousand Angstroms. They are obtained by known means such as deposition by vacuum sputtering of a uniform layer, followed by the photolithography of the desired pattern. The cathodoluminescent strips 7 are produced by known processes, e.g. by screen process printing of cathodoluminescent pastes, which contain, apart from the binder, a cathodoluminescent material e.g. zinc sulphide and grains of indium oxide in a variable proportion from 1 to 10%, the presence of these grains improving the electrical conduction of the screen process printed layer. The thickness of the cathodoluminescent strips is between a few microns and a few dozen microns. The conductive bars of the electron emission means 9 and 10 are made from a metal having a high electrical conductivity, e.g. aluminium, whereas the filaments 11 are made from tungsten.

Figure 2:
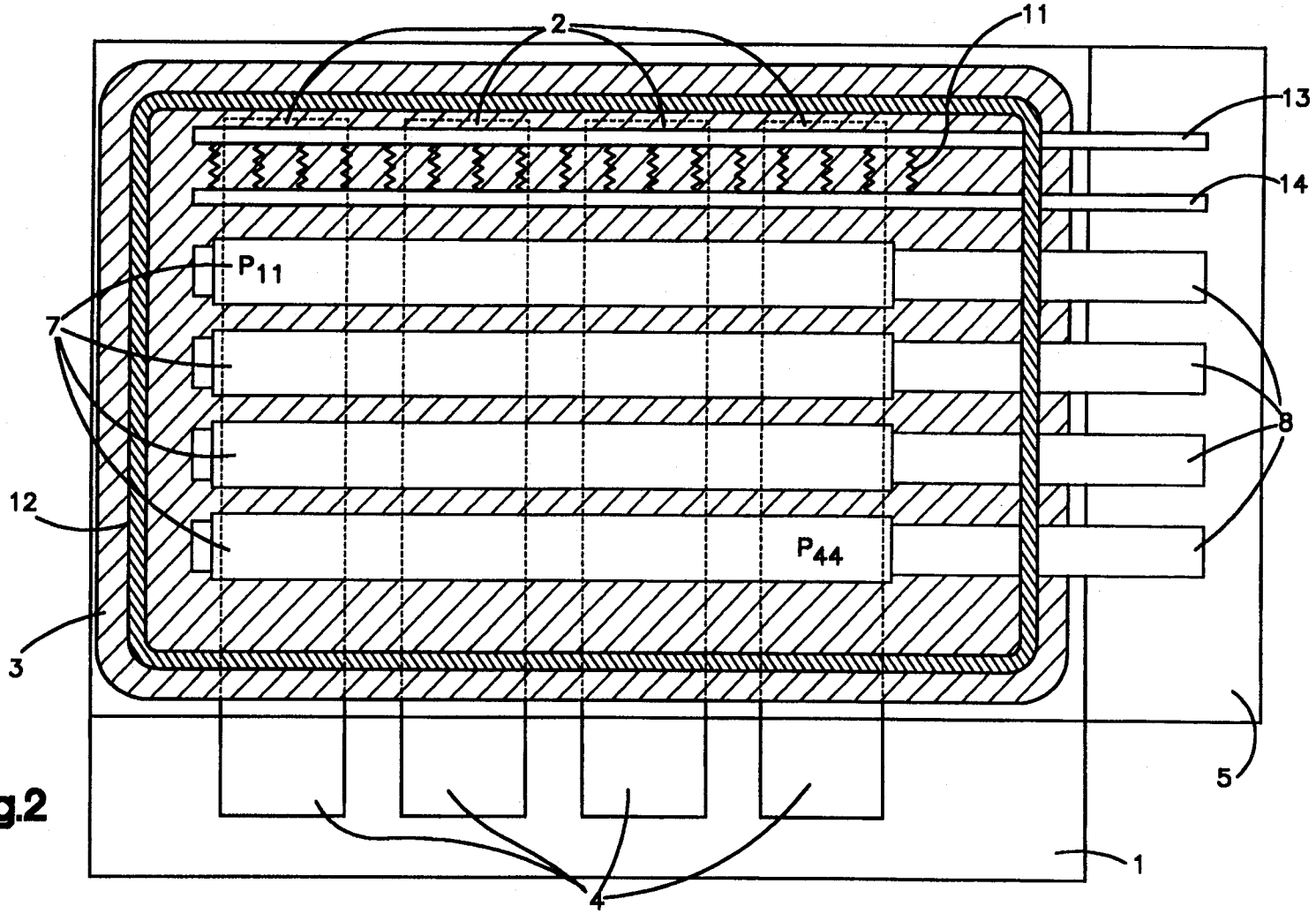

FIG. 2 is a plan view of the display cell once assembled. The intersection of the four rows and four columns defines 16 elementary points or dots of the image or picture referenced by a subscript of row i varying from 1 to 4 and a subscript of column j varying from 1 to 4, the dot $p_{11}$ being located at the top left and the dot $p_{44}$ at the bottom right.

A tight seal 12 makes it possible to maintain under vacuum the interior of the cell in contact with the cathodoluminescent strip 7, the filaments 11, part of the column electrodes 2 and part of the row electrodes 6, said parts corresponding at least to the intersection zone of the two arrays which is known as the useful zone of the screen.

The insulating layer 3 extends beyond the seal 12 so as to prevent any exchange of electrons between the interior of the cell and the column electrodes 4. The contact zones 4, 8, 13, 14 of the column electrodes 2, the row electrodes 6 and the conductive bars 9 and 10 of the electron emission means are accessible from the outside.

Figure 3A:
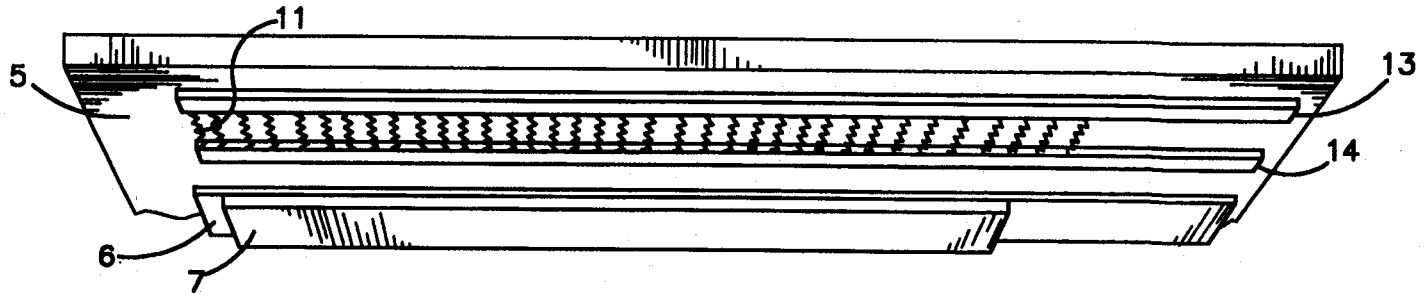
Figure 3B:
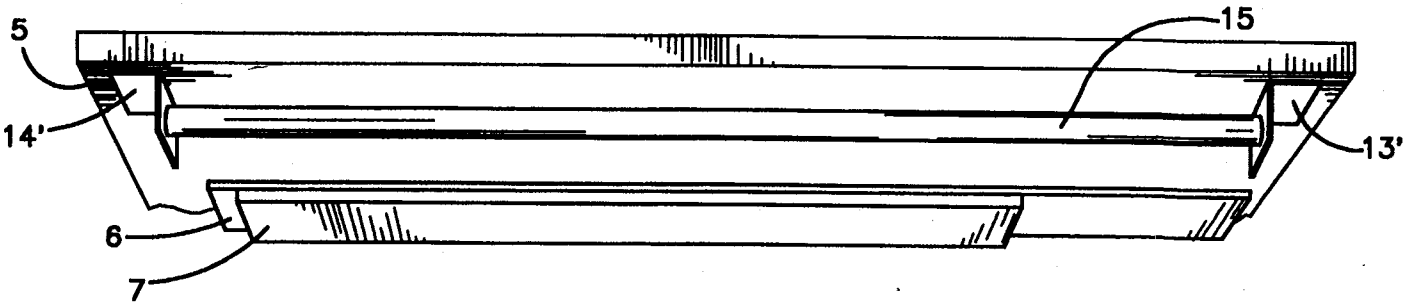
Figure 3C:
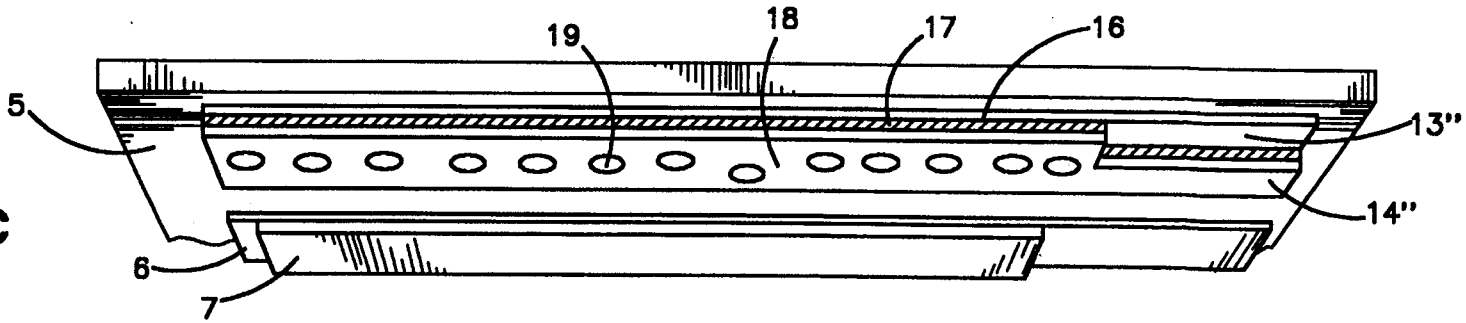

FIGS. 3A–3C show three known electron sources such as can be used in the display cell. FIG. 3*a* corresponds to an electron source constituted by microfilaments 11. The source is produced on the upper plate 5, parallel to the array of rows 6 and cathodoluminescent strips 7. The microfilaments 11 are connected to two conductive bars 9, 10 having ends 13, 14 which are accessible from the outside of the assembled cell.

FIG. 3*b* corresponds to an electron source constituted by a single filament 15, which is parallel to the arrays of the rows 6 and the cathodoluminescent strips 7. This filament is joined to the upper glass plate 5 by supports 13"and 14' serving as electrical contacts.

FIG. 3*c* corresponds to an electron source constituted by microdots emitting by the field effect. The electrons are extracted from a cathode 16 carrying the microdots 19. The gate 18 is separated from the cathode 16 by an electrically insulating Layer 17. The gate and the insulating layer are perforated in front of each microdot. The gate can be connected to a not shown, external control means by means of the contact zone 14" and the cathode can be connected to a not shown, external control means by the contact zone 13". The microdot electron source is produced on the upper glass plate 5 by known vacuum deposition and photolithography means. The process e.g. described in the international report "Japan Display 86" is suitable for producing the necessary electron source for the display means according to the invention.

A comparison of FIGS. 3*a*, 3*b* and 3*c* shows that the choice of the emission source does not modify the remainder of the display means.

Figure 4:
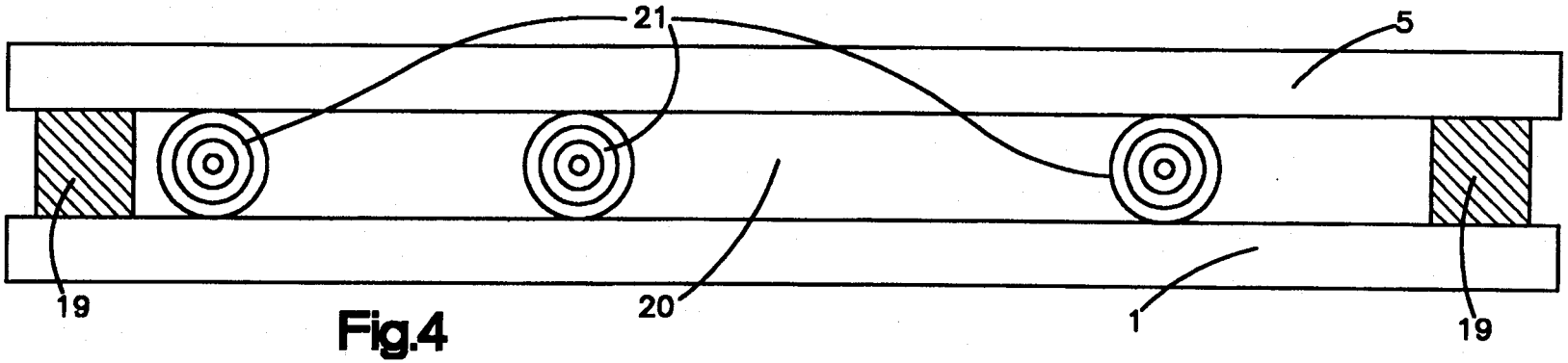

FIG. 4 shows an assembly diagram for the display cell. Between the two glass substrates 1 and 5 tightly assembled by a sealing cord or bead 19 is provided a vacuum volume 20. Vacuum is understood to be a pressure below 1/100,000 of atmospheric pressure. The distance separating the two glass substrates 1, 5 is kept constant by two spacers 21. As a result of the pressure difference between the vacuum volume 20 and the exterior at atmospheric pressure, the glass plates 1 and 5 are engaged against one another until they are in direct contact with the spacers. The number of spacers per square centimeter and the thickness of the plates 1 and 5 are adjusted so that the bending of the plates is negligible. The spacers 21 can be glass bells arranged in an arbitrary manner prior to assembly on one of the plates. Their diameter varies from a few dozen microns to a few hundred microns. A density of 100 to 1000 spacers per 1 $cm^2$ is appropriate for a glass plate thickness of about 1 mm. The seal 19 is e.g. brought about on the basis of a meltable glass heated to beyond its melting point during the display cell assembly stage.

Figure 5:
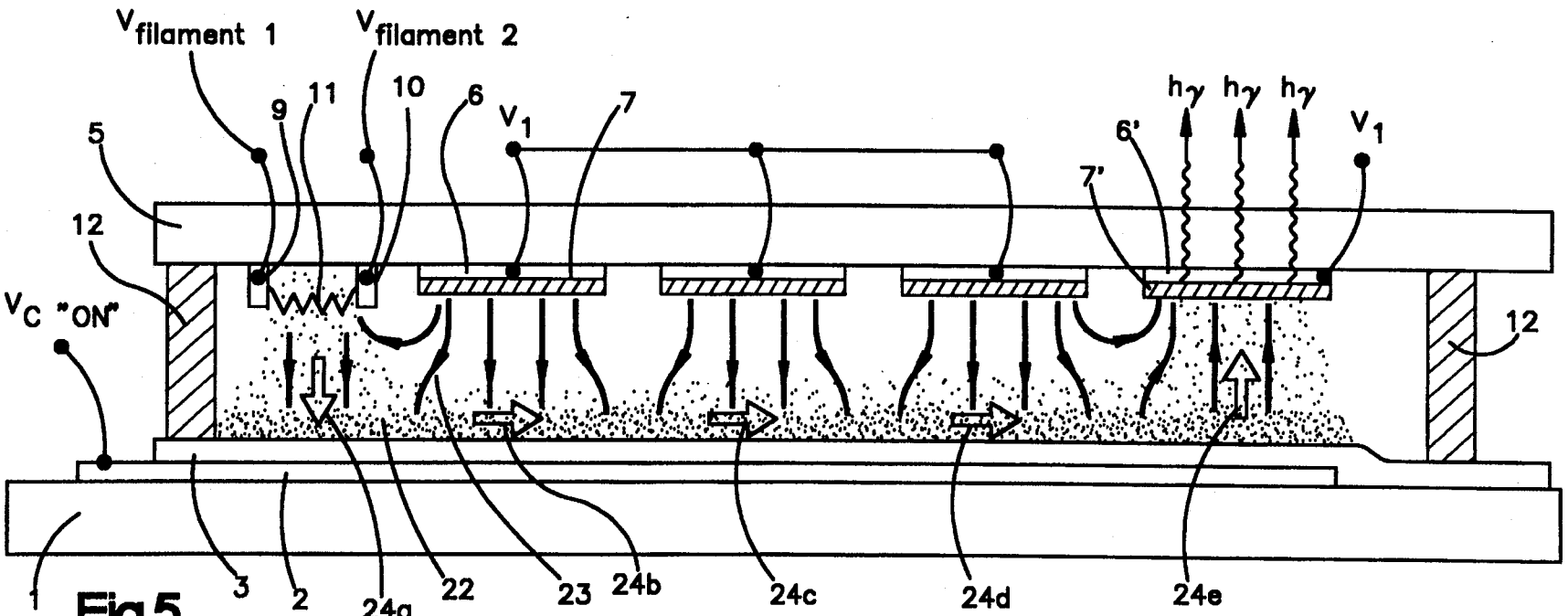

FIG. 5 shows how the electrons are guided along a column from the electron emitting source to a selected row, said guidance being obtained when the considered column is in the "ON" state.

A column is said to be in the "ON" state when the corresponding guidance electrode 2 is raised to a voltage $V_{c\text{"}ON\text{"}}$ higher than the voltages applied to the electron emission source, e.g. in the represented embodiment of a filament source above the voltages Filament 1 and Filament 2 respectively applied to the ends of the filaments via con-conductive bars 9 and 10. From the filament 11 to the guidance electrode 2 the electrons are accelerated by the electric field in the direction of the arrow 24*a*. Blocked by the insulating layer 3, they cannot be evacuated by the guidance electrode positioned beneath the insulant. They accumulate in the vicinity of the insulant forming in the vacuum a charge region 22. An image of the electron density within the charge region is given by the density of the dots representing the charge region. A high dot density is the image of a high electron density. To the right of FIG. 5, a selected row 6' is shown. The term selected row is understood to mean a row raised to a selected potential $V_1$ or in abbreviation $V_{ls}$ exceeding $V_{C\text{"}ON\text{"}}$.

The electrons of the charge region facing the selected row are attracted in the direction indicated by the arrow 24*e* and accelerated by the electric field established between the guidance column 2 and the selected row 6'. A selected row pumps the electrons from the charge region. To the left of the drawing, three non-selected rows 6 are shown. The term non-selected row means a row raised to a non-selected potential $V_1$ or abbreviated to $V_{lns}$ below the potentials applied to the electron source, e.g. in the case shown of a filament source below $V_{filament\,1}$ and $V_{filament\,2}$. The electric field established between the non-selected row 6 and the guidance electrode 2 is quasi-perpendicular to the plane of the display cell and is directed so as to drive back the electrons against the insulant, as indicated by the field lines 23.

However, although the electric field is perpendicular to the plane of the cell, a lateral movement of the electrons is reserved, as is indicated by the successive arrows 24*b*, 24*c* and 24*d*. This movement takes place under the pressure of diffusion forces tending to maintain constant the electron density in the charge region, despite the pumping of the electrons out of the charge region by the selected row 6' and the injection into the charge region of electrons from the filament 11.

Light emission is caused by the impact of the electrons pumped by the selected row 6' against the cathodoluminescent material of the cathodoluminescent strip 7'. This emission has a wavelength spectrum characteristic of the properties of the fluorescent material used and is symbolized by the emission of photons of energy hV.

Figure 6:
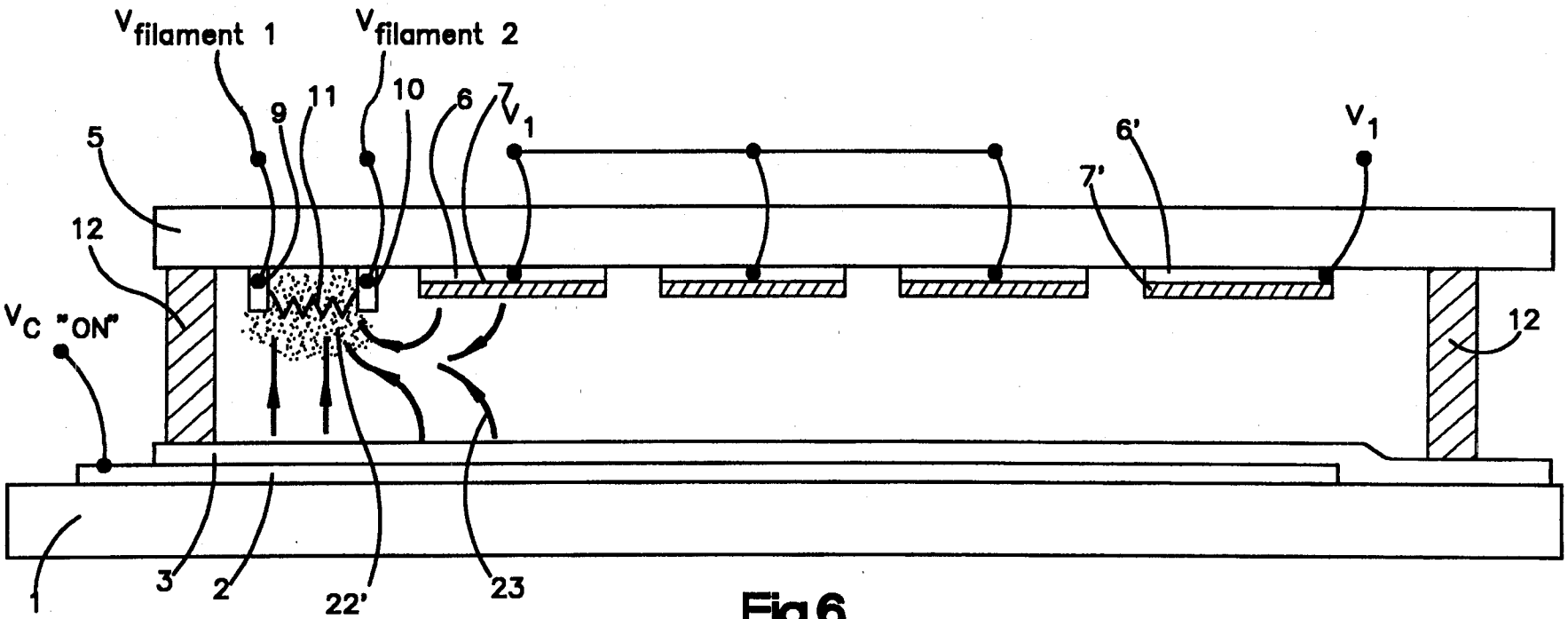

FIG. 6 shows the confinement of the electrons around the emission means, said confinement being obtained when the considered column is in the "OFF" state. A column is said to be in the "OFF" state when the guidance electrode corresponding thereto is raised to a voltage $V_{C\text{"}OFF\text{"}}$ below the voltages applied to the electron emitting means, e.g. in the case represented of a filament source below the voltages $V_{filament\,1}$ and $V_{filament\,2}$ applied to the filament 11 by means of the conductive bars 9 and 10. The adjacent row 6 is not selected, i.e. the row electrode corresponding thereto is raised to a non-selected voltage $V_1$, abbreviated to $V_{lns}$, below the voltages applied to the electron emitting means, e.g. in the represented case of a filament source below $V_{filament\,1}$ and $V_{filament\,2}$. The electrons emitted by the thermoionic effect outside the filament are driven back by the column and the adjacent first row and drop onto the filament. The charge region 22' is confined around the filament and no electron can reach the cathodoluminescent strip 7' covering the selected row 6'.

Figure 7:
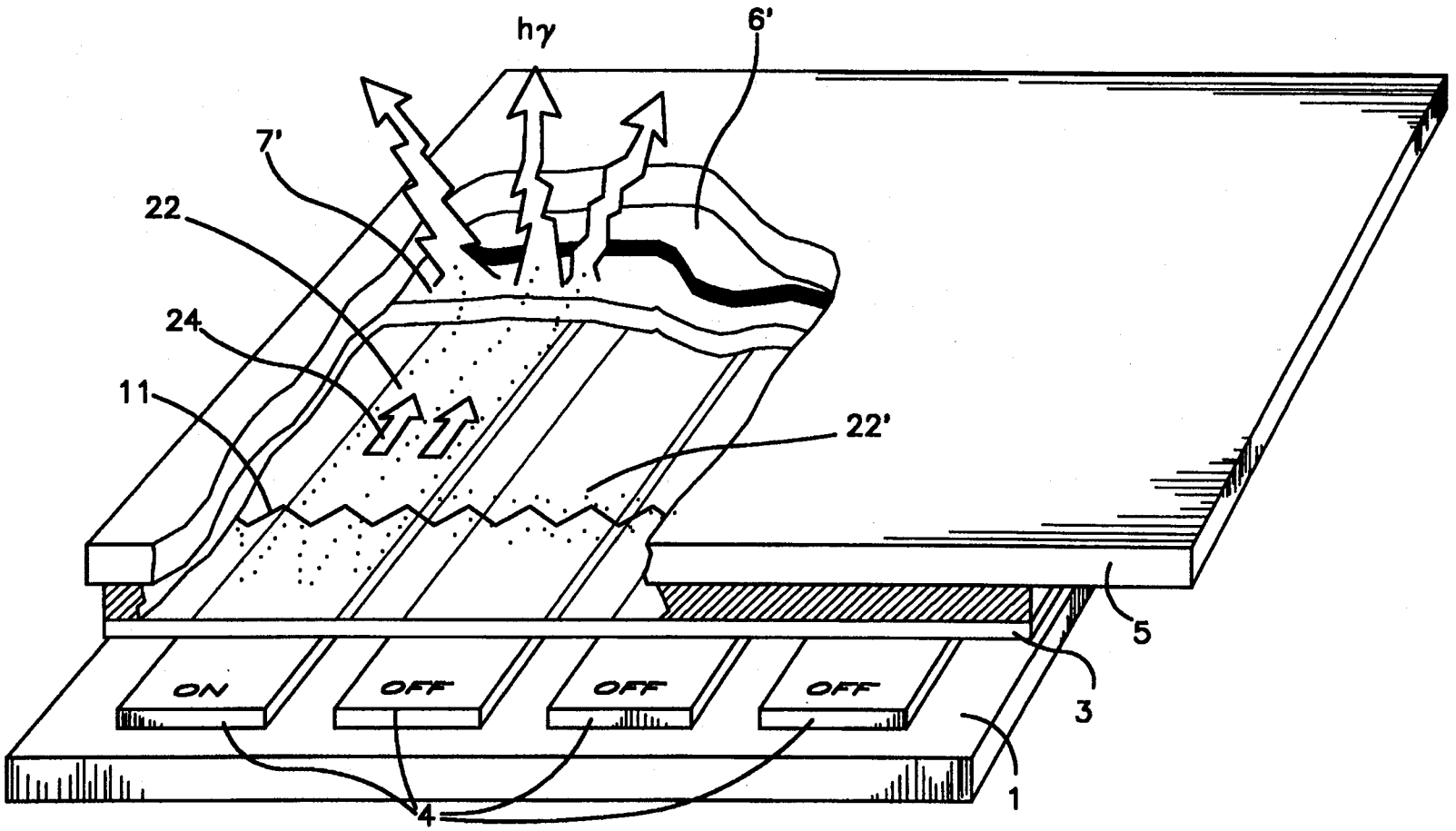

FIG. 7 shows an overall diagram of the operating display cell. A out made in the upper substrate reveals the mechanism separately described in FIGS. 5 and 6 and respectively corresponding to the guidance of the emitted electrons and to the confinement thereof on their source. The filament is symbolized by an accordion line 11. Through the cut made in the upper plate it is possible to see the selected row electrode 6' and the cathodoluminescent strip 7' covering it. The other, non-selected rows are not shown.

In front of the column electrode in the "ON" state, the electrons represented by dots 22 leave the filament, strike against the insulant 3, pass along the guidance electrode until perpendicular to the selected row in the direction indicated by the arrow 24, come beck to the selected electrode by striking the cathodoluminescent strip and bring about a light emission symbolized by the emission of photons of energy hV. In front of the column electrode in the "OFF" state, the electrons represented by the dots 22' are confined in the vicinity of the filament 11. None of them are transported to a random catholuminescent strip and no light emission is obtained facing the column electrode in the "OFF" state.

FIGS. 8A–8D illustrate a chronogram of the signals respectively applied to the filament-type electron source with one row and one column, said chronogram illustrating the control mode of the display means.

The frame time T corresponds to the sum of the selection times of each row. A time T equal to four $\tau$ is shown, which corresponds to a four-row display with selection times $\tau 1$, $\tau 2$, $\tau 3$, $\tau 4$ of the four rows all equal to $\tau$.

Figures 8A, 8B, 8C, 8D:
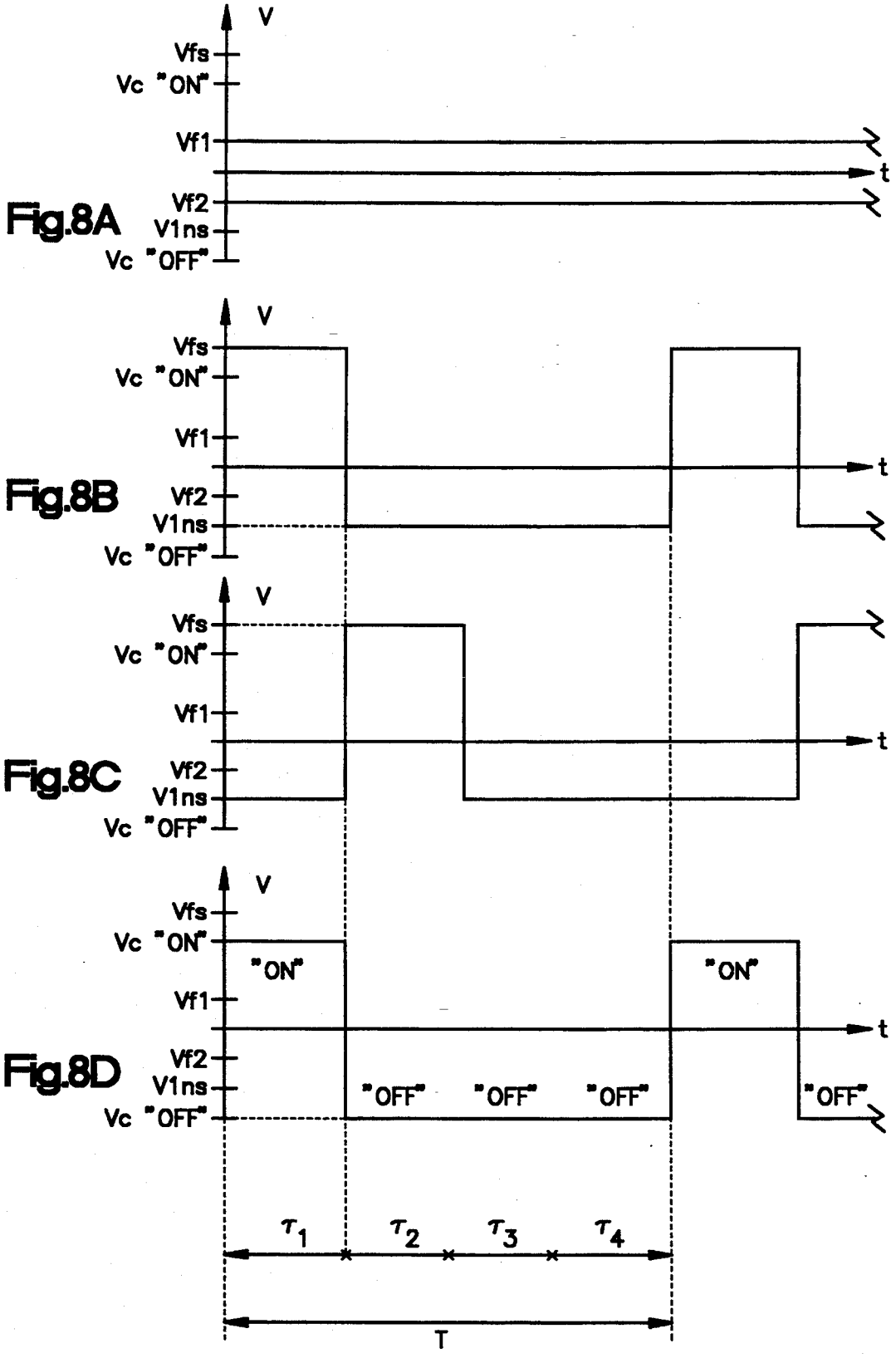

FIG. 8*a* shows the signal supplied to the electron source, which is of the filament type here and as shown in FIG. 3*a*. The signals are $V_{filament\,1}$ and $V_{filament\,2}$, which are continuous signals of constant amplitudes $V_{f1}$ and $V_{f2}$. In the chosen embodiment, $V_{f1}$ has been arbitrarily take as higher than $V_{f2}$.

FIG. 8*b* shows the signal applied to the first row of the display and during the time 1 the row 1 is selected. The signal $V_{row\ 1}$ has an amplitude $V_{ls}$ higher than $V_{f1}$ and $V_{f2}$. Outside the selection time, $V_{row\ 1}$ is equal to $V_{lns}$ below $V_{f1}$ and $V_{f2}$.

FIG. 8*c* represents the signal applied to the second row of the display. The signal $V_{row\ 2}$ is obtained by delaying by a time $\tau 1$ the signal previously described for row 1. In general terms, the signal of a row k is obtained by delaying by a time k−1 the signal of the row $\tau k-1$. FIG. 8*d* represents the signal of a column so as to illuminate the image point or dot corresponding to said column and in front of row 1 and extinguishing the image points or dots facing the subsequent rows. During the time $\tau 1$ $V_{column}$ is equal to $V_{C"ON"}$ than $V_{f1}$, $V_{f2}$ and $V_{ls}$. Outside the time $\tau l$, $V_{column}$ is equal to $V_{C"OFF"}$ and below $V_{f1}$ and $V_{f2}$.

I claim:

1. A cathodoluminescent display device comprising:

a lower plate (1) covered by an array of N column electrodes (2), each column being referred to by a number j, j being an integer from 1 to N;

an insulating layer (3) covering said lower plate and said column electrodes (2);

an upper plate (5) covered by an array of L row electrodes (6), each electrode being referred to by a number i, i being an integer from 1 to L, said row electrodes (6) being in orthogonal relationship with said column electrodes (2), each overlapping zone of said column electrodes (2) and said row electrodes (6) defining an elementary display dot;

a plurality of cathodoluminescent strips (7), each of the strips covering one of the row electrodes;

an electron emission source (11, 13, 14, 15, 16, 17, 18, 19) located on said upper plate (5) along and aside said array of row electrodes (6) and facing an extremity of said array of column electrodes (2);

a vacuum enclosure enclosing said arrays of electrodes and said electron emission source;

electrical means for applying to said electron emission source a voltage for electrons to be emitted;

means for applying to a selected column electrode (2) a first control voltage ($V_{C"ON"}$) higher than the voltage applied to said electron emission source, the electrons emitted by said electron emission source being thus accelerated toward the extremity of said selected column electrode;

means for applying to a selected row electrode (6') a second control voltage ($V_{ls}$) exceeding said first control voltage ($V_{C"ON"}$), the electrons previously accelerated toward the extremity of said selected column electrode thus experiencing a lateral movement along said selected column electrode at the surface of said insulating layer (3) and being then attracted by said selected row electrode (6') and impinging upon said cathodoluminescent strip (7') covering said selected row electrode (6'), thus causing a light emission on the display dot corresponding to the overlapping of said selected column electrode (2) and said selected row column (6').

2. A cathodoluminescent display device according to claim 1, wherein said array of column electrodes are covered by said insulating layer (3) but a portion of said column electrodes extends outside said vacuum enclosure.

3. A cathodoluminescent display device according to claim 1, wherein said array of row electrodes (6) are covered by said cathodoluminescent strip but a portion of said row electrodes extends outside said vacuum enclosure.

4. A cathodoluminescent display according to claim 1, wherein said electron emission source comprises a resistive filament connected to electrical means.

5. A cathodoluminescent display according to claim 1, wherein said electron emission source comprises a plurality of microfilaments and two conductive bars connected to said microfilaments, said conductive bars being connected to electrical means.

6. A cathodoluminescent display according to claim 1, wherein said electron emission source comprises microdots located on a first conducting layer deposited on said upper plate and a second conducting layer separated from said first conductive layer by an insulating layer, said second conductive layer having openings facing said microdots, said first and second conductive layers being connected to electrical means for making said microdots emit electrons through said holes.

7. A control process for controlling the cathodoluminescent display of any one of claims 1 to 6, comprising the steps of:

supplying to each row electrode a recurrent signal of a given period T having a selection sequence with a duration $\tau_i$ for each of said i row electrodes, and a non-selection sequence with a duration T-$\tau_i$;

applying to said electron emitting source a continuous voltage during the duration $\tau_i$ corresponding to the selection of one of said i row electrodes;

supplying to the other row electrodes during a selection sequence of said one of said i row electrodes electrical voltages corresponding to a non-selected state;

applying to said one of said i row electrodes a voltage having an amplitude $V_{ls}$ greater than the amplitude of the continuous voltage applied to said electron emitting source;

applying to said one of said i row electrodes, during a non-selection period, a voltage having an amplitude $V_{lns}$ lower than the amplitude of the continuous voltage applied to said electron emitting source;

applying to one of said j column electrodes a voltage of duration equal to said duration $\tau_i$ and of an amplitude $V_{C"ON"}$ higher than the amplitude of said continuous voltage applied to said electron emitting source and lower than the amplitude $V_{ls}$ applied to said one of said i row electrodes for obtaining light emission from a dot corresponding to an overlap of said one of said i row electrodes and said one of said j column electrodes;

applying to said one of said j column electrodes, during said duration $\tau_i$, a voltage of amplitude $V_{C"OFF"}$ lower than the amplitude of said continuous voltage applied to said electron emitting source for obtaining no light emission from the dot corresponding to the recovering of said one of said i row electrodes and said one of said j column electrodes.

* * * * *

UNITED STATES PATENT AND TRADEMARK OFFICE

CERTIFICATE OF CORRECTION

PATENT NO. : 5,430,459

DATED : July 4, 1995

INVENTOR(S) : Jean F. Clerc

It is certified that error appears in the above-indentified patent and that said Letters Patent is hereby corrected as shown below:

On title page, the following information should be inserted with respect to Attorney, Agent or Firm: --Pearne, Gordon, McCoy & Granger--.

Column 1, line 37, delete "bean." and insert --beam--;
line 40, delete "fiat" and insert --flat--; and
line 46, delete "delay" and insert --display--.

Column 2, line 13, delete "Of" and insert --of--;
line 51, after "example" delete --.-- (comma); and
line 63, delete "listed" and insert --existed--.

Column 3, line 2, delete "Using" and insert --using--;
line 10, delete "theft" and insert --that--; and
line 19, delete "Angstroms" and insert --Angströms--.

Column 4, line 16, delete ".the" and insert --the--;
line 25, after "second" insert --,-- (comma);
line 32, delete "lower" and insert --greater--;
line 32, after "than the" insert --amplitudes--;
line 40, after "column" insert --j--;
line 45, delete "seine" and insert --same--;
line 52, delete "DRAWINGS" and insert --DRAWING--; and
line 56, delete "show".

UNITED STATES PATENT AND TRADEMARK OFFICE

CERTIFICATE OF CORRECTION

PATENT NO. : 5,430,459

DATED : July 4, 1995

INVENTOR(S) : Jean F. Clerc

It is certified that error appears in the above-indentified patent and that said Letters Patent is hereby corrected as shown below:

Column 5, line 16, after "the" (second occurrence) insert --present--;
line 18, delete "EMBODIMENT" and insert --EMBODIMENTS--;
line 22, after "plate" (first occurrence) insert --1--;
line 36, delete "Angstroms" and insert --Angströms--;
line 41, delete "Angstroms" and insert --Angströms--; and
line 66, delete "1" and insert --5--.

Column 6, line 1, delete "Angstroms" and insert --Angströms--;
line 52, delete "13" and insert --13'--; and
line 57, delete "Layer" and insert --layer--.

Column 7, line 33, delete "Filament 1" and insert --$V_{filament}$--;
line 34, delete "Filament 2" and insert --$V_{filament}$--; and
line 67, delete "reserved" and insert --observed--.

Column 8, line 35, delete "out" and insert --cut--; and
line 48, delete "beck" and insert --back--.

UNITED STATES PATENT AND TRADEMARK OFFICE

CERTIFICATE OF CORRECTION

PATENT NO. : 5,430,459

DATED : July 4, 1995

INVENTOR(S) : Jean F. Clerc

It is certified that error appears in the above-indentified patent and that said Letters Patent is hereby corrected as shown below:

Column 9, line 18, before "than" insert --higher--.

Column 10, line 33, (claim 7, line 7) delete --$T_{-\tau i}$--
insert --$T_{-\tau i}$--.

Signed and Sealed this

Seventh Day of November, 1995

*Attest:*

*Attesting Officer*

BRUCE LEHMAN

*Commissioner of Patents and Trademarks*